US006341769B1

(12) United States Patent
Lin et al.

(10) Patent No.: US 6,341,769 B1
(45) Date of Patent: Jan. 29, 2002

(54) NON-CONTACT PICK-UP DEVICE

(75) Inventors: Chun-Hung Lin; Tzer-Kun Lin; Yun-Chuan Tu, all of Hsinchu; Hann-Tsong Wang, Hsinchui; Chin-Ching Wu, Hsinchu, all of (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 09/779,657

(22) Filed: Feb. 9, 2001

(30) Foreign Application Priority Data

Nov. 17, 2000 (TW) ..... 89219883

(51) Int. Cl.[7] ..... B25B 11/00
(52) U.S. Cl. ..... 269/21; 451/388; 269/20
(58) Field of Search ..... 457/388; 248/362, 248/363; 269/21, 20; 279/3 R; 294/64.1

(56) References Cited

U.S. PATENT DOCUMENTS 5,421,595 A * 6/1995 Cripe et al. ..... 279/3
5,671,910 A * 9/1997 Davies et al. ..... 269/21
6,196,532 B1 * 3/2001 Otwell ..... 269/21

* cited by examiner

*Primary Examiner*—Derris H. Banks
*Assistant Examiner*—Daniel Shanley
(74) *Attorney, Agent, or Firm*—Troxell Law Office PLLC

(57) ABSTRACT

A non-contact pick-up device is disclosed. The non-contact pick-up device mainly includes a disk, and a plurality of air nozzles on the disk. Each nozzle has an air channel; and an upper end of the channel is tilt outwards. Therefore, as a disc-shaped article is placed on the disk; air jets out from the nozzles, due to Bernoulli principle, pressure difference is formed on the disc-shaped article. Thus, due to the action of atmosphere pressure, the disc-shaped article will be clamped. The pick-up device may be used in semiconductor manufacturing process for clamping a wafer.

5 Claims, 4 Drawing Sheets

NON-CONTACT PICK-UP DEVICE

FIELD OF THE INVENTION

The present invention relates to a non-contact pick-up device, and especially to a pick-up device which may be used in the manufacturing process of semiconductor for clamping a wafer.

BACKGROUND OF THE INVENTION

In the manufacturing process, often, it is necessary to clamp a manufacturing material for performing necessary processes. For example, in the front stage of the manufacturing process of a semiconductor wafer, A plasma platform is used in etching, deposition, and cleaning. The use of plasma platform is important and widely used in the front stage of the manufacturing process of the semiconductor wafer. In the plasma platform, a wafer is placed in a wafer clipper, while the pick-up device is placed between the wafer and the wafer clipper for retaining the wafer so that the wafer is steadily fixed. In general, the pick-up device is classified into mechanical clamping devices and electrostatic clamping device.

A prior art clamping device disclosed in U.S. Pat. No. 4,692,836 is illustrated in FIG. 1, wherein the electrodes of the electrostatic clamping device has an absorbing disk 2 with a thickness a placed on a supporting frame 1. A wafer 3 is placed on the absorbing disk 2. b is the curvature due to the non-uniformity of the electrostatic force, however, this is not the key point of the present invention, and thus the details will not described herein. The electrodes 4 are connected to the absorbing disk 2 and a substrate. A DC voltage is applied to the electrodes. However, in this design, the conductive wire is necessary to be connected to the electrostatic clamping device and the wafer, and thus as a wafer is updated, the conductive wire must be connected further. Moreover, due to a voltage applying to the wafer, the electric property of the wafer is changed.

Supports for disk-shaped articles by using mechanical clamping device have also been known from U.S. Pat. Nos. 4,903,717 and 5,492,566. In thus conventional support, these supports do not exhibit any propping means in the surface facing the disk-shaped article so that the latter is returned in the support exclusively by Bernoulli's on a gas cushion forming between the disk-shaped article and the support. In that patent, a mechanical clamping device includes a lower cup-shaped article 7 and an upper cup-shaped article 8. The lower cup-shaped article 7 is an annular air channel 101 and is formed as a channel with the upper cup-shaped article 8. Moreover, a disc-shaped article 10 is placed above the upper cup-shaped article 8. The air flows into an annular air channel 101 from the channel 6. Since air flows through the channel, according to Bernoulli concept, the air will generate a pressure difference on the surface of the disc-shaped article 10. However, the pressure difference from a flowing air will be smaller than atmosphere pressure applied on another surface of the disc-shaped article 10 and thus, the atmosphere pressure applies a pressure on the disc-shaped article 10 to clamp the disc-shaped article 10 to the cup-shaped article 8.

Such a prior art design has still defects, for example, air jets out from a single outlet. Since the mechanical errors (for example, the error of air channel 101 generated in the manufacturing process; the assembly of the components; the wearing due to operation through a long time period), the airflow becomes non-uniform in the airflow channel and thus, the clamping force of the upper disk 8 to the disc-shaped article 10 is not uniform. However, for the precision elements, slight errors will induce bad products. For example, in the manufacturing process of a wafer (i.e., the disk body 100 is a wafer), since the progress of semiconductor technology, a manufacturing process of 0.13 micrometer is developed. In such a fine manufacturing process, a slight error will induce a difficulty in precision control of the products.

SUMMARY OF THE INVENTION

Accordingly, the primary object of the present invention is to provide a non-contact type thin plate clamping device, wherein the shifting and parallel levels of the disc-shaped article are detectable by a photodetector. And then by a self detecting/controlling module, the amount of jetting air can be adjusted so as to correct the shifting and parallel levels.

Another object of the present invention is to provide a non-contact type thin plate clamping device, wherein in the present invention, by the number of the nozzles and a control module, the shifting and parallel levels of the disc-shaped article 10 can be well controlled.

A further object of the present invention is to provide a non-contact type thin plate clamping device, wherein since air jets out from the nozzles, the air generating in the manufacturing process will not flow into the air channel so as to destroy the whole mechanism.

The other object of the present invention is to provide a non-contact type thin plate clamping device, wherein since the air jets out from the nozzles, the air generating in the manufacturing process will not contact the surfaces of the disk body (such as the surfaces of a wafer), and thus, the chemical property of the back side of the wafer will be retained in the original condition.

To achieve above objects, the present invention is to provide a non-contact type thin plate clamping device that utilized the Bernoulli principle to provide the pick-up force. The non-contact pick-up device mainly includes a disk, and a plurality of air nozzles above the disk. Each nozzle having an air channel; an upper end of the channel is tilt outwards. Therefore, as a disc-shaped article is placed on the disk; the air jets out from the nozzles, due to Bernoulli theory, a periphery of the disc-shaped article has pressure difference. Thus, due to the action of atmosphere pressure, the disc-shaped article will be clamped. The pick-up device may be used in the manufacturing process of semiconductor for clamping a wafer.

The various objects and advantages of the present invention will be more readily understood from the following detailed description when read in conjunction with the appended drawing.

BRIEF DESCRIPTION OF THE DRAWINGS

FIG. 3A shows the speed distribution for the air jetting out on the non-contact pick-up device of the present invention.

DETAILED DESCRIPTION OF THE PREFERRED EMBODIMENTS

Figure 1:
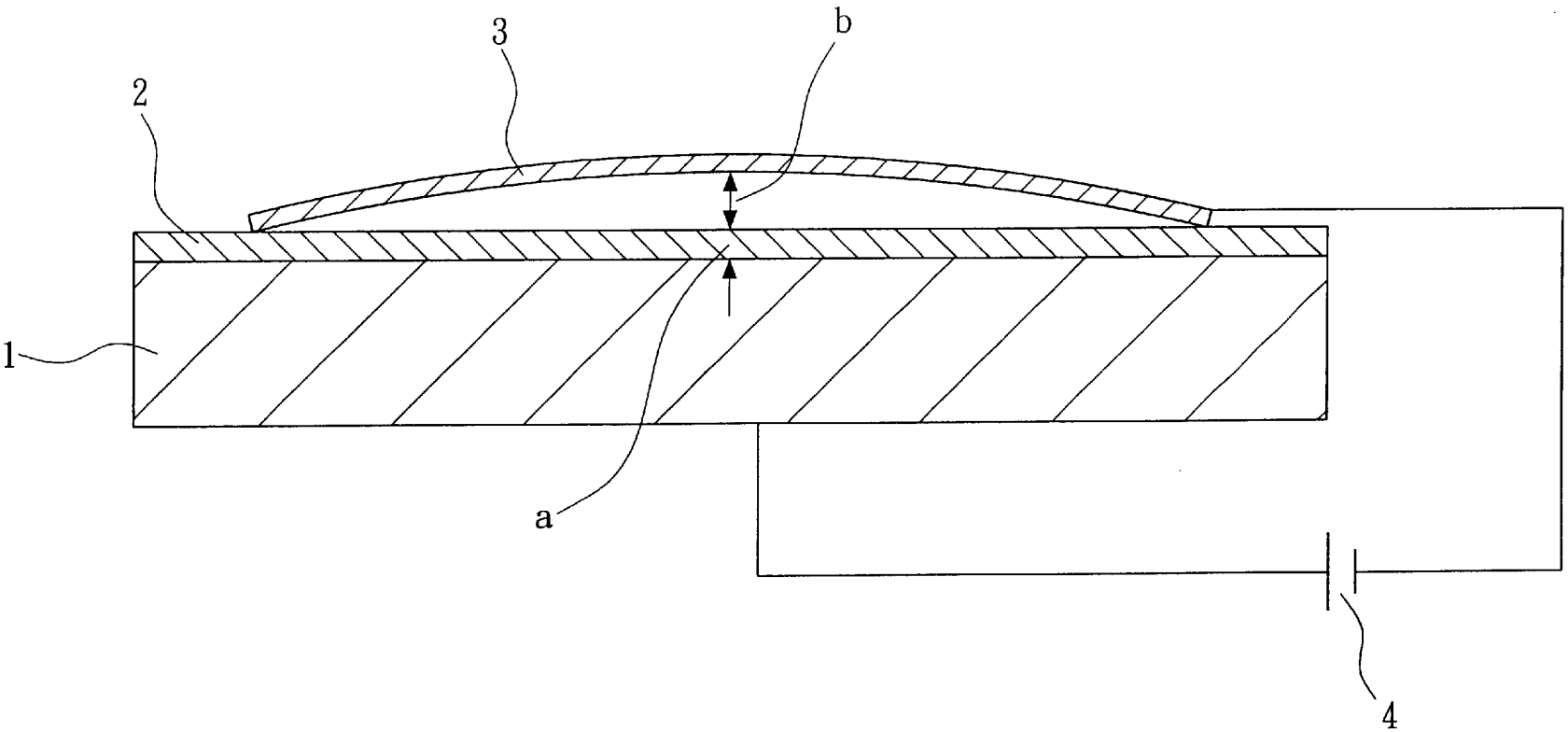
FIG. 1 (PRIOR ART)
FIG. 1 is a lateral view of a non-contact electrostatic clamping device in the prior art.
Figures 2A, 2B:
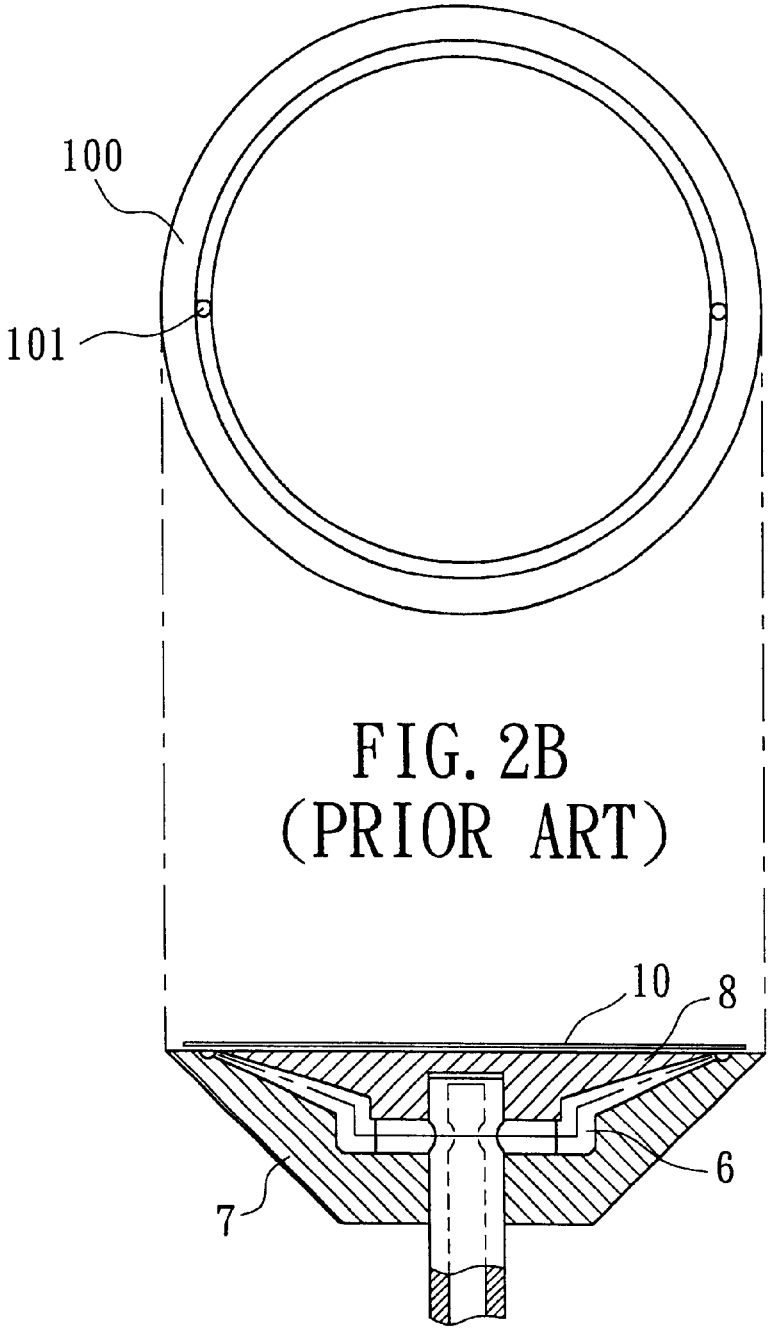
FIG. 2B (PRIOR ART)
FIG. 2A (PRIOR ART)
FIG. 2A is a lateral view of a non-contact mechanical clamping device in the prior art.
FIG. 2B is an upper view of a non-contact mechanical clamping device in the prior art.

The present invention will be described in the following with the appended drawings. Those skilled in the art may learn the practice of the present invention from the description. However, all these embodiments described herein are just used as examples while not used to confine the scope and spirit of the present invention defining in the appended claims.

In order to solve the aforesaid problems in the prior art, in the present invention a novel design is disclosed. As illustrated in FIGS. 3A to 3C and FIG. 4, the non-contact pick-up device of the present invention mainly includes a disk 500, a positioning stopper 300, a plurality of nozzles 20 forming by a housing 800 and may be symmetrically distributed, an air chamber 200, and a rectifier 400 therein, wherein an upper end of the rectifier 400 has a tapered shape.

In using, air flows into an air inlet 11 on the housing 800. Then a rotating airflow is formed as the air flows along the circular gap between the air chamber 200 and the rectifier 400. Then, the air flows along the semicircle flow channel 201 formed by the tilt surface 700 of the rectifier 400 and the tilt surface 900 of the housing 800. Then, the air jets out to the outer periphery of the disk 500 from the semicircle outlet 600. When the pick-up device of the present invention is near the disc- shaped article 10, since the installing of the stopper 300, the disc- shaped article 10 can be placed on the disk 500 rapidly. Furthermore, since air only jets out from the semicircle outlet 600, the air only flows to the outer periphery of the disc-shaped article 10.

One advantage of the present invention is that air jets out to the outer periphery of the disk 500 along the tilt surface of the rectifier 400, and therefore, the possibility of air flowing toward the center of the disk 500 is reduced. As a result, the thrust in the center of the disk is cancelled effectively. Further, through the rectifying effect of the rectifier 400, the air does not jet out vertically from the surface of the disk. Therefore, the airflow is smoothly and uniformly distributed. The speed of the airflow will not vary dramatically due to the dramatic change of the airflow. The pressure difference is uniformly distributed, and thus the absorption force is more uniform so that the disc-shaped article is absorbed strongly and the stress thereon is decreased.

Figure 3C:
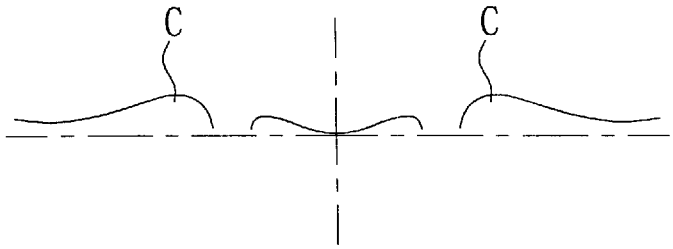
FIG. 3A is an upper view of the non-contact pick-up device in the present invention.
FIG. 3B is a lateral cross sectional view of the non-contact pick-up device in the present invention.
Figure 3B:
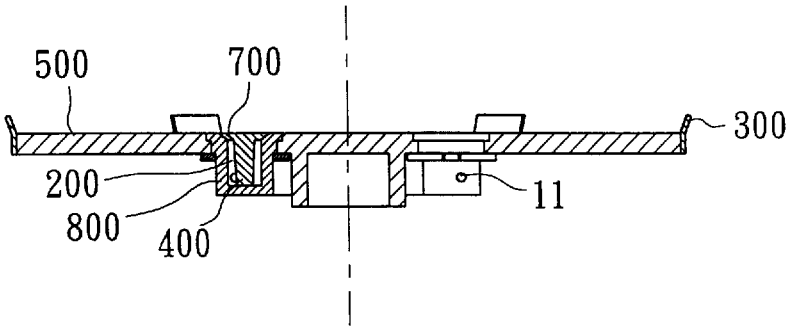
Figure 3A:
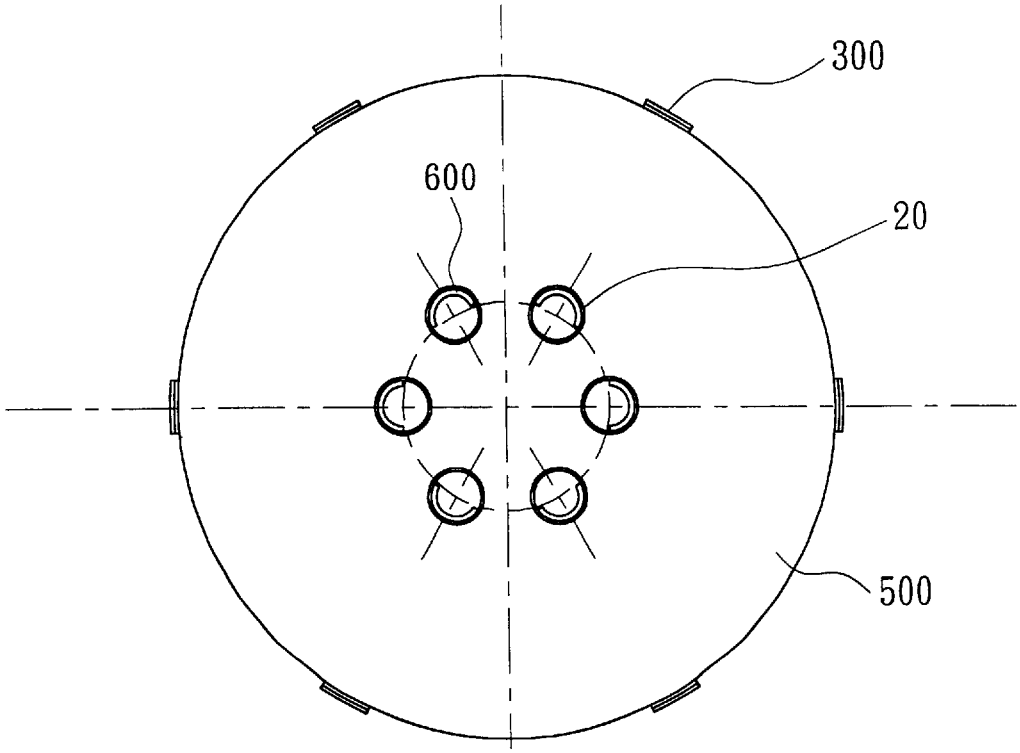
Figure 4:
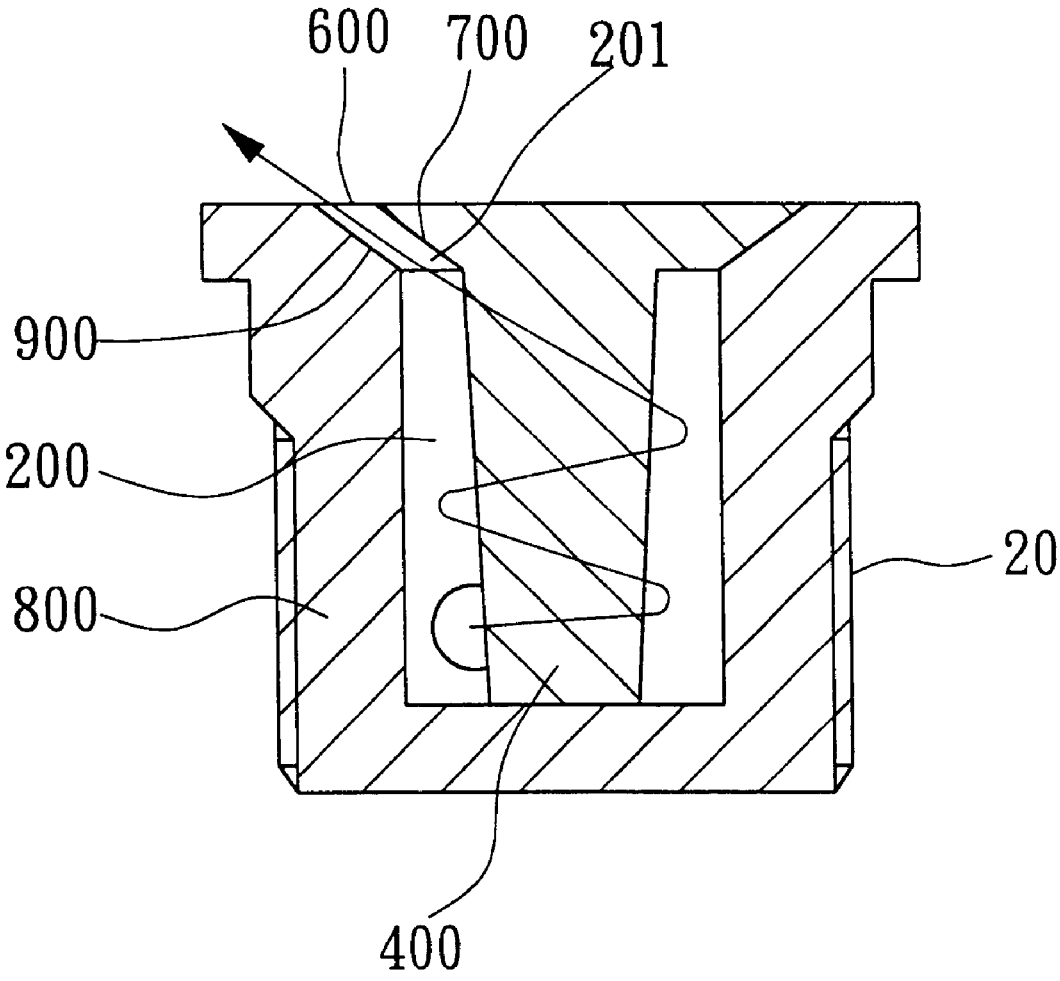
FIG. 4 is an enlarged cross-sectional view of the housing and rectifier of the present invention.

Referring to FIG. 3C, a distribution of the airflow is illustrated as air jets out, viewing from a cross section of the disk 500. In that, the air flowing toward the center of the disk 500 will be cancelled with each other. Therefore, the air speed is 0, while at the outer side of the nozzles, the air speed is maximum. For the portion a little away from the nozzle to the periphery of the disk, it is shown that the air speed is reduced due to the stopping effect of atmosphere.

According to Bernoulli principle, the pressure of an airflow is inverse proportional to the square of the air speed. Therefore, in point C of FIG. 3C, the air pressure is minimum. At another surface of the disk body 100, the air pressure (pressure of atmosphere) is uniform distributed, and thus, at point C, the disk body 100 has a maximum adhering force to the disk 500.

The advantages of the present invention will be described in the following:

1. The shifting or parallel levels of the disc-shaped article 10 are detectable by a photodetector. And then by a self detecting/controlling module, the amount of jetting air can be adjusted so as to correct the shifting and parallel levels.

2. In the present invention, by the number of the nozzles and a control module, the shifting and parallel levels of the disc-shaped article 10 can be well controlled.

3. Since air jets out from the nozzles, the air generating in the manufacturing process will not flow into the air channel so as to destroy the whole mechanism.

4. Since the air jets out from the nozzles, the air generating in the manufacturing process will not contact the surfaces of the disk body (such as the surfaces of a wafer), and thus, the chemical property of the backside of the wafer will be retained in the original condition.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pick-up device for a semiconductor wafer comprising:

a) a planar disk having a pick-up surface, a center and a periphery, and including a plurality of positioning stoppers on the periphery extending above the pick-up surface; and, b) a plurality of gas outlet nozzles extending through the pick-up surface, the nozzles being arranged in a circular array around the center of the disk, each nozzle comprising an arcuate flow channel bounded on opposite sides by surfaces inclined toward the periphery so as to direct a gas from the nozzle toward the periphery of the disk such that, when a semiconductor wafer is placed adjacent to the pick-up surface, the gas flowing from the nozzles creates a reduced pressure between the pick-up surface and the wafer.

2. The pick-up device of claim 1 further comprising a housing mounted on the disk, the housing having the plurality of gas outlet nozzles and a gas inlet.

3. The pick-up device of claim 2 further comprising a plurality of rectifiers mounted in the housing such that a space between each of the plurality of rectifiers and the housing forms the gas outlet nozzle.

4. The pick-up device of claim 3 wherein each rectifier has a tapered portion.

5. The pick-up device of claim 1 wherein the gas outlet nozzles are equidistantly spaced apart.

* * * * *